US009316967B2

(12) United States Patent
Fukai

(10) Patent No.: US 9,316,967 B2
(45) Date of Patent: Apr. 19, 2016

(54) IMAGE FORMING APPARATUS WITH PRESSURE CONTACT SEPARATION SECTION TO SEPARATE FIXING SIDE MEMBER AND BACKSIDE SUPPORTING MEMBER FROM EACH OTHER

(71) Applicant: Konica Minolta, Inc., Chiyoda-ku, Tokyo (JP)

(72) Inventor: Shougo Fukai, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/629,882

(22) Filed: Feb. 24, 2015

(65) Prior Publication Data

US 2015/0241823 A1 Aug. 27, 2015

(30) Foreign Application Priority Data

Feb. 24, 2014 (JP) ..... 2014-033026

(51) Int. Cl.
*G03G 15/20* (2006.01)

(52) U.S. Cl.
CPC ..... *G03G 15/2032* (2013.01); *G03G 15/2067* (2013.01)

(58) Field of Classification Search
CPC ..... G03G 15/2032; G03G 15/205; G03G 15/2067
See application file for complete search history.

(56) References Cited

U.S. PATENT DOCUMENTS

| | | | | | |
|---|---|---|---|---|---|
| 5,436,430 | A | * | 7/1995 | Baruch et al. | 219/216 |
| 5,475,481 | A | * | 12/1995 | Nishikawa et al. | 399/297 |
| 5,956,554 | A | * | 9/1999 | Yanashima et al. | 399/328 |
| 2006/0088326 | A1 | * | 4/2006 | Nakayama | 399/69 |

FOREIGN PATENT DOCUMENTS

| | | | |
|---|---|---|---|
| JP | 08262898 | A | 10/1996 |
| JP | 2004205879 | A | 7/2004 |
| JP | 2008233770 | A | 10/2008 |

OTHER PUBLICATIONS

Notice of Reasons for Rejection for Corresponding JP Application No. 2014-033026; date of dispatch: Mar. 1, 2016, with English Translation.

* cited by examiner

*Primary Examiner* — Sandra Brase
(74) *Attorney, Agent, or Firm* — Cantor Colburn LLP

(57) ABSTRACT

An image forming apparatus includes: a sheet conveyance section; an image forming section; a fixing section; a driving section configured to rotate a back side supporting member; a pressure contact separation section; and a cooling section configured to cool down the back side supporting member. The sheet feeding path has a configuration in which a long sheet makes contact with the back side supporting member when the fixing side member and the back side supporting member are separated from each other. During cooling-down or warming-up of the fixing section, the pressure contact separation section separates the fixing side member and the back side supporting member from each other, the cooling section cools down the back side supporting member, and the driving section rotates the back side supporting member.

12 Claims, 6 Drawing Sheets

IMAGE FORMING APPARATUS WITH PRESSURE CONTACT SEPARATION SECTION TO SEPARATE FIXING SIDE MEMBER AND BACKSIDE SUPPORTING MEMBER FROM EACH OTHER

CROSS REFERENCE TO RELATED APPLICATIONS

This application is entitled to and claims the benefit of Japanese Patent Application No. 2014-033026, filed on Feb. 24, 2014, the disclosure of which including the specification, drawings and abstract is incorporated herein by reference in its entirety.

BACKGROUND OF THE INVENTION

1. Field of the Invention

The present invention relates to an electrophotographic image forming apparatus for forming an image on a long sheet.

2. Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

When long sheets such as roll paper and continuous paper (continuous form paper) are used for image formation in the above-mentioned image forming apparatus, the long sheets stay in the sheet conveyance path during a non-image formation period such as a standby state (idling state). In particular, when a long sheet is kept sandwiched at a fixing nip during the warming-up prior to the start of an image formation or during the cooling-down after an image formation, discoloration (burn) or deformation of a long sheet is caused due to the heat directly transmitted to the long sheet. For this reason, normally, a fixing side member (for example, a fixing roller) for forming a fixing nip and a back side supporting member (for example, a pressure roller) are separated from each other.

However, since the distance between the fixing side member and the back side supporting member separated from each other is normally about 2 to 3 mm, a long sheet makes contact with the fixing side member when the long sheet is slackened. Such a problem may be solved by separating the fixing side member and the back side supporting member from each other by a great distance as necessary. In addition, it has been proposed to appropriately convey a long sheet so as not to slacken a long sheet (see, for example, PTL 1: Japanese Patent Application Laid-Open No. 2008-233770).

Furthermore, the above-mentioned problem may be solved by providing a heat insulating mechanism for blocking heat transmission from a fixing side member to a long sheet, by using highly heat-resistant long sheets, or by continuing the feeding of long sheets even during the non-image formation period.

However, when a heat insulating mechanism is provided, or when the fixing side member and the back side supporting member are separated from each other by a great distance as necessary, the size of the image forming apparatus is increased. When a heat insulating mechanism is provided, the number of components is increased, and the cost of the apparatus is also increased.

In addition, when only highly heat-resistant long sheets can be used in an apparatus, such an apparatus is not useful and cannot be used as a product. In addition, when the feeding of long sheets is continued even during the non-image formation period, the number of waste sheets (wasted sheets) is increased, which is a serious disadvantage as a product.

SUMMARY OF THE INVENTION

An object of the present invention is to provide a useful image forming apparatus which can prevent discoloration or deformation of a long sheet during a non-image formation period (in particular, during warming-up or cooling-down) without raising problems such as increase in the size of the apparatus and increase in the cost of the apparatus.

To achieve at least one of the abovementioned objects, an image forming apparatus reflecting one aspect of the present invention includes: a sheet conveyance section configured to convey a long sheet; an image forming section configured to transfer a toner image to a long sheet; a fixing section including a fixing side member configured to make contact with a fixing surface of a long sheet, a back side supporting member configured to be brought into pressure contact with the fixing side member so as to form a fixing nip, and a heating section configured to apply heat to the fixing side member, the fixing section being configured to apply heat and pressure to a long sheet conveyed along a sheet feeding path at the fixing nip so as to fix the toner image; a driving section configured to rotate the back side supporting member; a pressure contact separation section configured to bring the fixing side member and the back side supporting member into pressure contact with each other, or separate the fixing side member and the back side supporting member from each other; and a cooling section configured to cool down the back side supporting member, wherein: the sheet feeding path has a configuration in which a long sheet makes contact with the back side supporting member when the fixing side member and the back side supporting member are separated from each other; and, during cooling-down or warming-up of the fixing section, the pressure contact separation section separates the fixing side member and the back side supporting member from each other, the cooling section cools down the back side supporting member, and the driving section rotates the back side supporting member.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, an embodiment of the present invention is described in detail with reference to the drawings.

Figure 1:
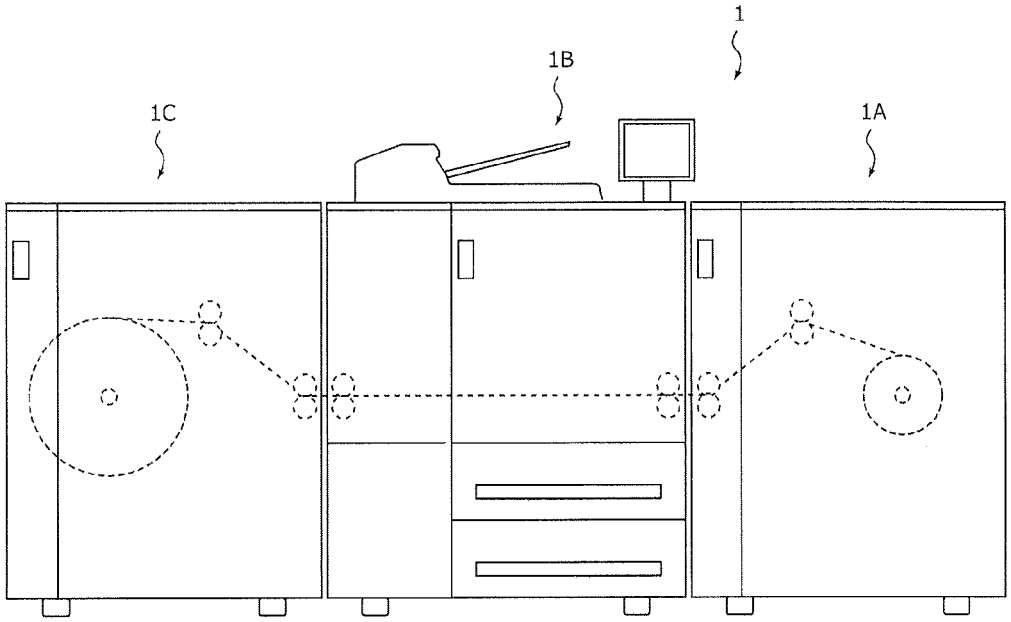
FIG. 1 illustrates an image forming apparatus according to an embodiment of the present invention.

FIG. 1 illustrates a configuration of image forming apparatus 1 according to the embodiment of the present invention.

Image forming apparatus 1 illustrated in FIG. 1 includes sheet feeding apparatus 1A, image forming apparatus main body 1B, and winding apparatus 1C.

Sheet feeding apparatus 1A stores therein long sheets such as roll paper and continuous paper, and feeds sheets under the instruction of image forming apparatus main body 1B for example. Image forming apparatus main body 1B forms an image on a long sheet fed from sheet feeding apparatus 1A. Winding apparatus 1C winds up the output long sheet on which an image has been formed by image forming apparatus main body 1B.

Figure 2:
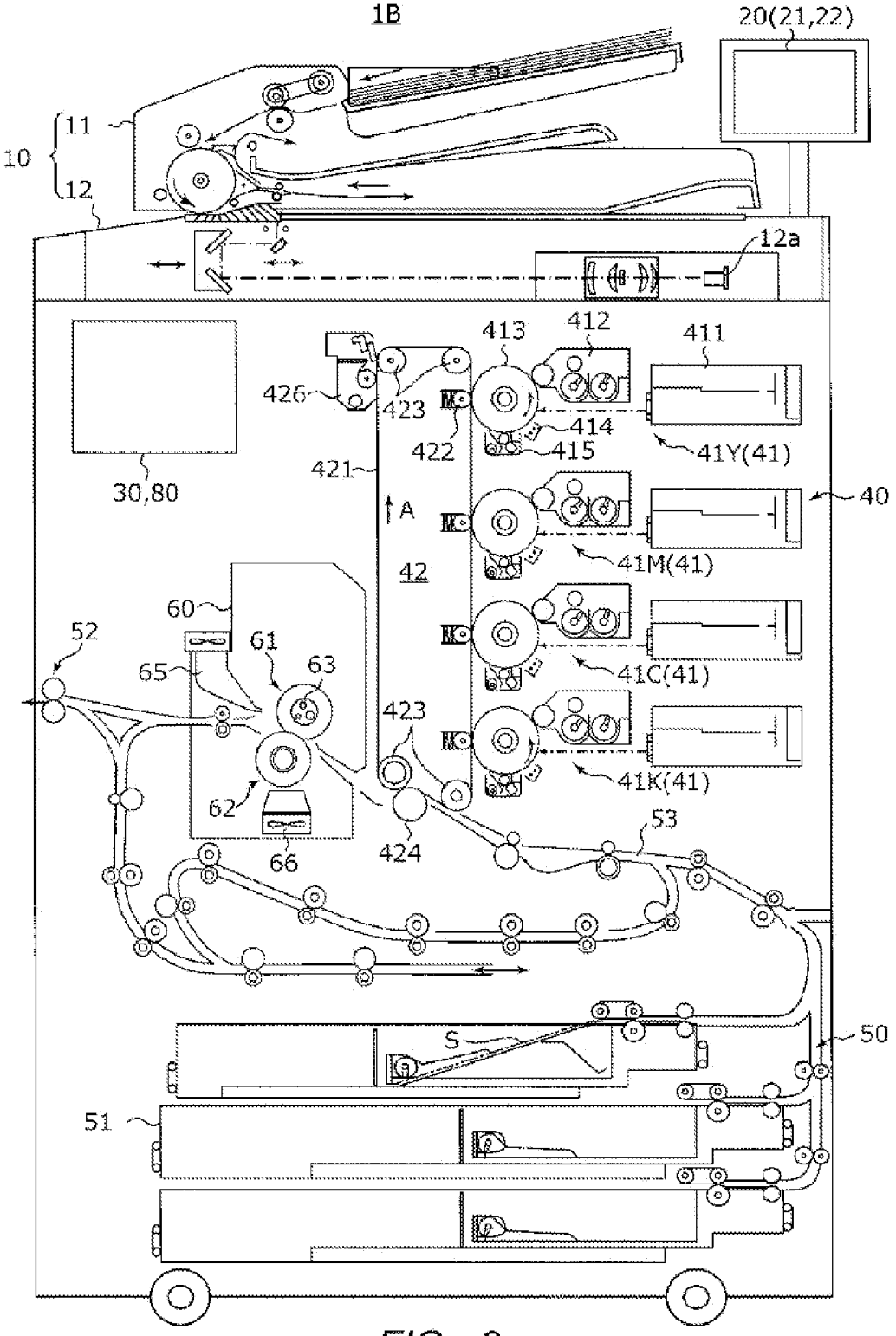
FIG. 2 illustrates a general configuration of an image forming apparatus main body.
Figure 3:
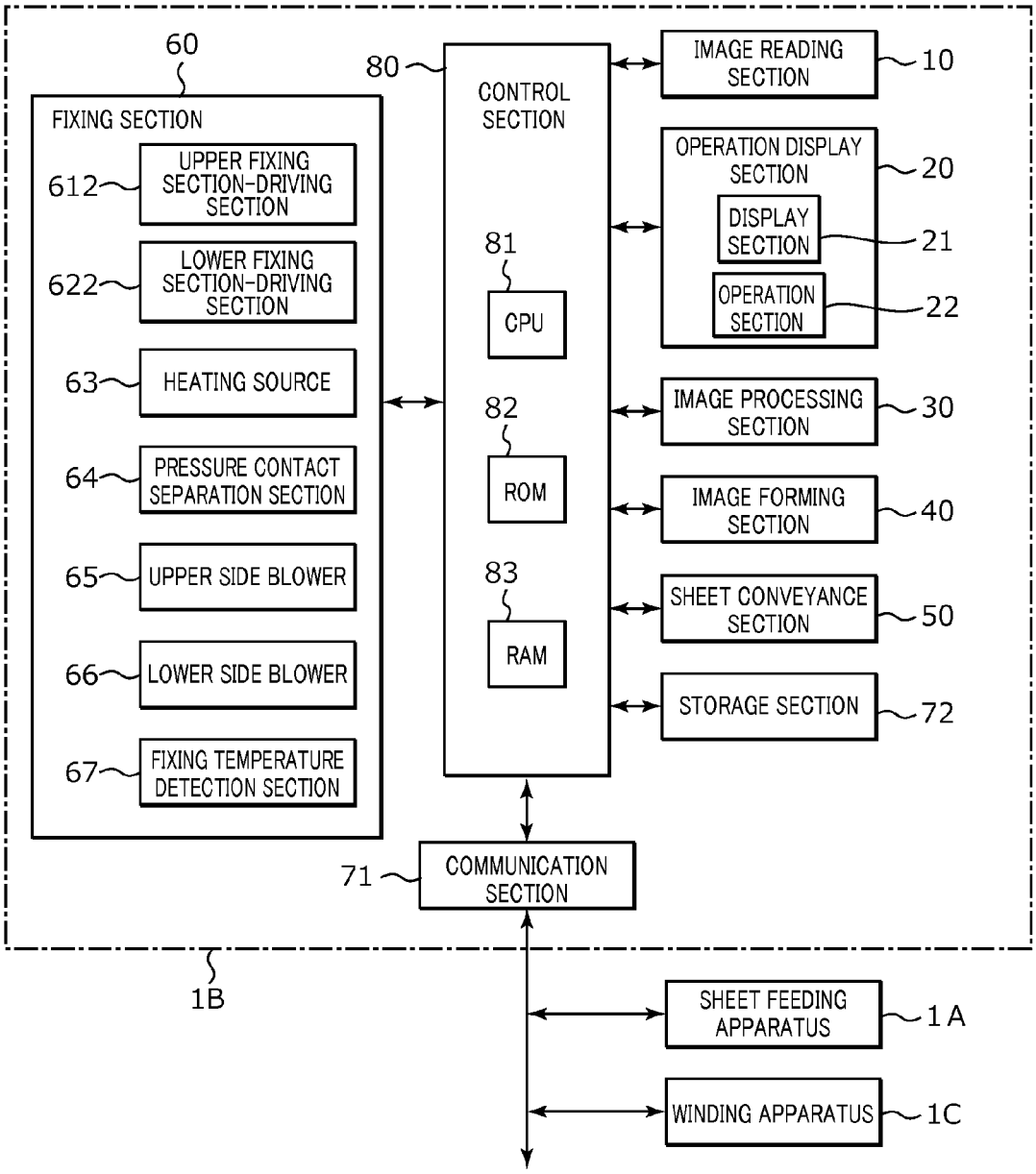
FIG. 3 illustrates a principal part of a control system of the image forming apparatus main body.

FIG. 2 illustrates a general configuration of image forming apparatus main body 1B. FIG. 3 illustrates a principal part of a control system of image forming apparatus main body 1B.

Image forming apparatus main body 1B illustrated in FIGS. 2 and 3 is a color image forming apparatus of an intermediate transfer system using electrophotographic process technology. A longitudinal tandem system is adopted for image forming apparatus main body 1B. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

That is, image forming apparatus main body 1B transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus main body 1B transfers (secondary-transfers) the resultant image to a sheet, to thereby form an image.

As illustrated in FIGS. 2 and 3, image forming apparatus main body 1B includes image reading section 10, operation display section 20, image processing section 30, image forming section 40, sheet conveyance section 50, fixing section 60, and control section 80.

Control section 80 includes central processing unit (CPU) 81, read only memory (ROM) 82, random access memory (RAM) 83 and the like. CPU 81 reads a program suited to processing contents out of ROM 82 or storage section 72, develops the program in RAM 83, and integrally controls the operation of each block of image forming apparatus 1B, sheet feeding apparatus 1A and winding apparatus 1C in cooperation with the developed program.

Communication section 71 has various interfaces such as network interface card (NIC), modulator-demodulator (MODEM), and universal serial bus (USB), for example.

Storage section 72 is composed of, for example, a non-volatile semiconductor memory (so-called flash memory) or a hard disk drive. Storage section 72 stores therein a look-up table which is referenced when the operation of each block is controlled, for example.

Control section 80 transmits and receives various data to and from an external apparatus (for example, a personal computer) connected to a communication network such as a local area network (LAN) or a wide area network (WAN), through communication section 71. Control section 80 receives image data (input image data) of page description language (PDL) that has been sent from an external device, and controls the apparatus to form an image on a sheet on the basis of the data, for example. In addition, control section 80 transmits and receives various data to and from sheet feeding apparatus 1A and winding apparatus 1C, through communication section 71.

Image reading section 10 includes auto document feeder (ADF) 11, document image scanner (scanner) 12, and the like.

Auto document feeder 11 causes a conveyance mechanism to feed documents placed on a document tray, and sends out the documents to document image scanner 12. Auto document feeder 11 enables images (even both sides thereof) of a large number of documents placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Display section 21 displays various operation screens, image statuses, the operating conditions of each function, and the like in accordance with display control signals received from control section 80. Operation section 22 includes various operation keys such as a numeric keypad and a start key, receives various input operations performed by a user, and outputs operation signals to control section 80.

By operating operation display section 20, the user can perform setting relating to the image formation such as document setting, image quality setting, multiplying factor setting, application setting, output setting, single-sided/duplex printing setting, and sheet setting.

Image processing section 30 includes a circuit that performs digital image processing suited to initial settings or user settings on the input image data, and the like. For example, image processing section 30 performs tone correction on the basis of tone correction data (tone correction table), under the control of control section 80. Image processing section 30 also performs various correction processes such as color correction and shading correction as well as a compression process, on the input image data. Image forming section 40 is controlled on the basis of the image data that has been subjected to these processes.

Image forming section 40 includes: image forming units 41 for images of colored toners respectively containing a Y component, an M component, a C component, and a K component on the basis of the input image data; intermediate transfer unit 42; and the like.

Image forming unit 41 includes image forming units 41Y, 41M, 41C, and 41K for the Y component, the M component, the C component, and the K component. Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 2, reference signs are given to only the elements of image forming unit 41Y for the Y component, and reference signs are omitted for the elements of other image forming units 41M, 41C, and 41K.

Image forming unit 41 includes exposing device 411, developing device 412, photoconductor drum 413, charging device 414, drum cleaning device 415, and the like.

Photoconductor drum 413 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through exposure to light by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 414 is composed of a corona discharging generator such as a scorotron charging device and a corotron charging device, for example. Charging device 414 evenly negatively charges the surface of photoconductor drum 413 by corona discharge.

Exposing device 411 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 413, and the like. Each of the LEDs of LED array 1 corresponds to one dot of an image. Control section 80 controls the LPH driving section to cause a predetermined driving current to flow through the LED array, and thus designated LEDs emit light.

Exposure device 411 irradiates photoconductor drum 413 with light corresponding to the image of each color component. The positive charge generated in the charge generation layer of photoconductor drum 413 is transported to the surface of the charge transport layer, whereby the surface charge (negative charge) of photoconductor drum 413 is neutralized. Thus, an electrostatic latent image of each color component is formed on the surface of photoconductor drum 413 by the potential difference from its surroundings.

Developing device 412 stores developers of respective color components (for example, two-component developers composed of toner and magnetic carrier). Developing device 412 attaches the toners of respective color components to the surface of photoconductor drum 413, and thus visualizes the electrostatic latent image to form a toner image. To be more specific, a developing bias voltage is applied to a developer bearing member (developing roller), and, by the potential difference between photoconductor drum 413 and the developer bearing member, the charged toner on the developer bearing member is moved and attached to a light-exposed part on the surface of photoconductor drum 413.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, support roller 423 disposed on the downstream side in the belt travelling direction relative to primary transfer support rollers 422 for K-component is a driving roller. When driving roller rotates, intermediate transfer belt 421 travels in an arrow A direction at a constant speed.

Primary transfer rollers 422 are disposed on the inner periphery side of intermediate transfer belt 421 in such a manner as to face photoconductor drums 413 of respective color components. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is so disposed as to face one of support rollers 423, on the outer periphery side of intermediate transfer belt 421. Support roller 423 that is so disposed as to face intermediate transfer belt 421 is called "backup roller." Secondary transfer roller 424 is brought into pressure contact with the backup roller with intermediate transfer belt 421 therebetween, whereby a secondary transfer nip for transferring a toner image from intermediate transfer belt 421 to a sheet is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when the sheet passes through the secondary transfer nip, the toner image on intermediate transfer belt 421 is secondary-transferred to the sheet. To be more specific, a secondary transfer bias is applied to secondary transfer roller 424, and an electric charge opposite to that of the toner is applied to the rear side (the side that makes contact with secondary transfer roller 424) of the sheet, whereby the toner image is electrostatically transferred to the sheet. The sheet on which the toner image has been transferred is conveyed toward fixing section 60.

Belt cleaning device 426 includes a belt cleaning blade configured to make sliding contact with the surface of intermediate transfer belt 421, and the like, and removes a transfer residual toner remaining on the surface of intermediate transfer belt 421 after the secondary transfer.

Alternatively, in intermediate transfer unit 42, it is also possible to adopt a configuration (so-called belt-type secondary transfer unit) in which a secondary transfer belt is installed in a stretched state in a loop form around a plurality of support rollers including a secondary transfer roller.

Fixing section 60 includes: upper fixing section 61 having a fixing side member disposed on a fixing surface (the surface on which a toner image is formed) side of a sheet; lower fixing section 62 having a back side supporting member disposed on the rear surface (the surface opposite to the fixing surface) side of a sheet; heating source 63 for applying heat to the fixing side member; pressure contact separation section 64 configured to bring the back side supporting member into pressure contact with the fixing side member; upper side blower 65 that applies air to the fixing side member; lower side blower 66 that applies air to the back side supporting member; fixing temperature detection section 67 that detects the temperature (fixing temperature) of the fixing side member; and the like.

For example, when upper fixing section 61 is of a roller heating type, the fixing roller serves as the fixing side member, and when upper fixing section 61 is of a belt heating type, the fixing belt serves as the fixing side member. In addition, for example, when lower fixing section 62 is of a roller pressing type, the pressure roller serves as the back side supporting member, and when lower fixing section 62 is of a belt pressing type, the pressing belt serves as the back side supporting member. The fixing side member and back side supporting member are also collectively called "fixing member."

Upper fixing section 61 includes upper fixing section-driving section 612 for rotating the fixing side member. When control section 80 controls the operation of upper fixing section-driving section 612, the fixing side member rotates (travels) at a predetermined speed. Lower fixing section 62 includes lower fixing section-driving section 622 for rotating the back side supporting member. When control section 80 controls the operation of the lower fixing section-driving section 622, the back side supporting member rotates (travels) at a predetermined speed. It is to be noted that, in the case where the fixing side member follows the rotation of the back side supporting member, the upper fixing section-driving section 612 is not required.

Heating source 63 is disposed inside or near the fixing side member. When control section 80 controls the output of heating source 63, the fixing side member is heated, and the fixing temperature is maintained at a predetermined temperature (for example, a fixable temperature, or a fixation idling temperature). On the basis of the detection result of fixing temperature detection section 67 disposed at a position near the fixing side member, control section 80 controls the output of heating source 63.

In addition, when control section 80 controls the operation of pressure contact separation section 64 such that the back side supporting member is brought into pressure contact with the fixing side member, a fixing nip for conveying a sheet in a tightly sandwiching manner is formed. In this manner, a toner image is secondary-transferred, and heat and pressure are applied to a sheet which has been conveyed along a sheet feeding path, at the time when the sheet passes through the nip portion. Thus, the toner image is fixed to the sheet.

Upper side blower 65 includes a cooling fan, and functions as a fixing side cooling section that, after a series of image formation processes are completed, cools down the fixing side member so as to reestablish the standby state, for example.

Lower side blower 66 includes a cooling fan, and functions as a rear surface side cooling section that, after a series of image formation processes are completed, cools down the back side supporting member so as to reestablish the standby state, for example. In addition, lower side blower 66 can be used for limiting temperature rise of the back side supporting member during the image formation period.

Sheet conveyance section 50 includes sheet feeding section 51, sheet ejection section 52, sheet feeding path section 53, and the like.

Paper sheets (standard type sheets and special type sheets) each discriminated based on the basis weight, size, and the like thereof are stored on a predetermined type basis in respective three sheet tray units of sheet feeding section 51.

Sheet feeding path section 53 includes a plurality of roller sections including an intermediate conveyance roller section, a loop roller section, and a registration roller section. Sheet feeding path section 53 conveys to image forming section 40 (secondary transfer section) sheets (including long sheets) fed from sheet feeding section 51 or sheet feeding apparatus 1A.

The long sheet fed from sheet feeding apparatus 1A is conveyed to image forming section 40 by sheet feeding path section 53. Thereafter, a toner image on intermediate transfer belt 421 is secondary-transferred to a first surface (fixing surface) of the long sheet at one time at the time when the long sheet passes through the transfer nip, and then a fixing process is performed in fixing section 60. The long sheet on which an image has been formed is ejected out of the image forming apparatus by sheet ejection section 52 provided with a sheet discharging roller and the like, and then wound by winding apparatus 1C.

Figure 4A:
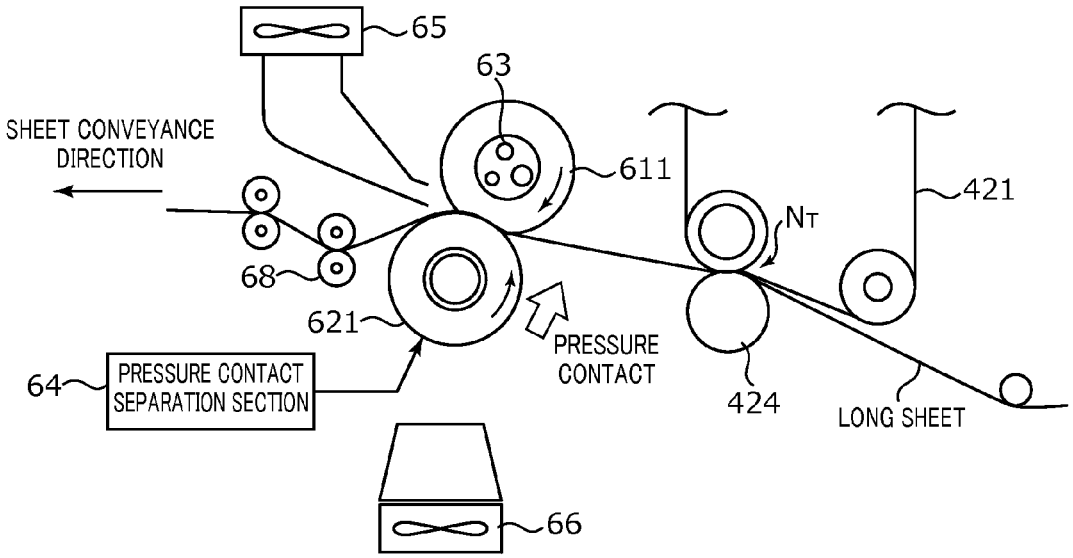
FIG. 4A illustrates an exemplary state (pressure contact state) of a sheet feeding path in a fixing section.
Figure 4B:
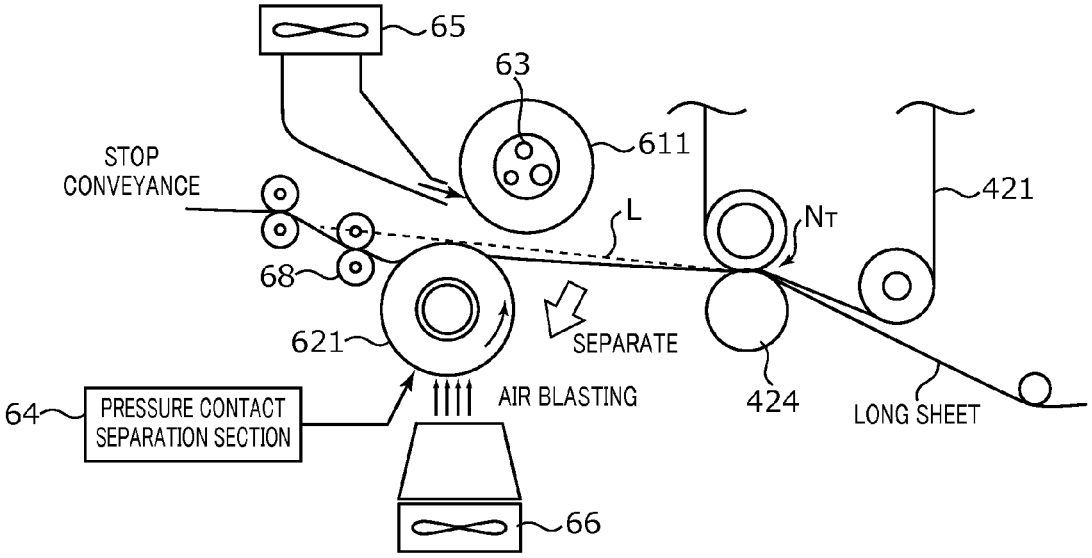
FIG. 4B illustrates an exemplary state (separation state) of the sheet feeding path in the fixing section.

FIGS. 4A and 4B each illustrate an exemplary sheet feeding path in fixing section 60. FIGS. 4A and 4B each illustrate a configuration in which upper fixing section 61 is of a roller heating type, and lower fixing section 62 is of a roller pressing type. That is, in FIGS. 4A and 4B, fixing roller 611 is a fixing side member, and pressure roller 621 is a back side supporting member.

In image forming apparatus 1, during the non-image formation period during which the image formation is not performed, conveyance of long sheets is stopped. At this time, if conveyance of long sheets is stopped with a long sheet sandwiched at the fixing nip, the heat of fixing roller 611 directly transmits to the long sheet, and the long sheet is discolored or deformed. In view of this, fixing roller 611 and pressure roller 621 are brought into pressure contact with each other during the image formation period (see FIG. 4A), and fixing roller 611 and pressure roller 621 are separated from each other during the non-image formation period.

As illustrated in FIG. 4A and FIG. 4B, restriction roller section 68 for restriction of the sheet feeding path is disposed on the downstream side of the fixing nip in the sheet conveyance direction. As illustrated in FIG. 4B, in the separation state, restriction roller section 68 is disposed such that the nip of restriction roller section 68 is located downwardly of tangent L to pressure roller 621 that passes through secondary transfer nip $N_T$. That is, in the example illustrated in FIGS. 4A and 4B, a long sheet is pressed against pressure roller 621 because of the shape of the sheet feeding path. Thus, during the non-image formation period, a long sheet is pressed against pressure roller 621, and consequently the heat transmission from fixing roller 611 is limited.

When image forming apparatus 1 is in a standby state (idling state), the fixing temperature of fixing roller 611 is maintained at a temperature (hereinafter referred to as "idling temperature") at which discoloration and deformation of a long sheet are not caused, and thus discoloration and deformation are not caused even when conveyance of long sheets is stopped in the state illustrated in FIG. 4B.

On the other hand, during the warming-up for starting image formation, and during the cooling-down subsequent to the completion of image formation, the fixing temperature of fixing roller 611 is higher than the idling temperature. Therefore, even when a long sheet is separated from fixing roller 611, discoloration or deformation may possibly be caused. To deal with this problem, in the present embodiment, pressure roller 621 is cooled down by air blasting from lower side blower 66, and pressure roller 621 rotates while making contact with a long sheet so as to cool down the long sheet during the warming-up and cooling-down of fixing section 60. Thus, it is possible to prevent a long sheet from being discolored or deformed due to heat transmission from fixing roller 611 to the long sheet during the warming-up or cooling-down of fixing section 60.

Figure 5:
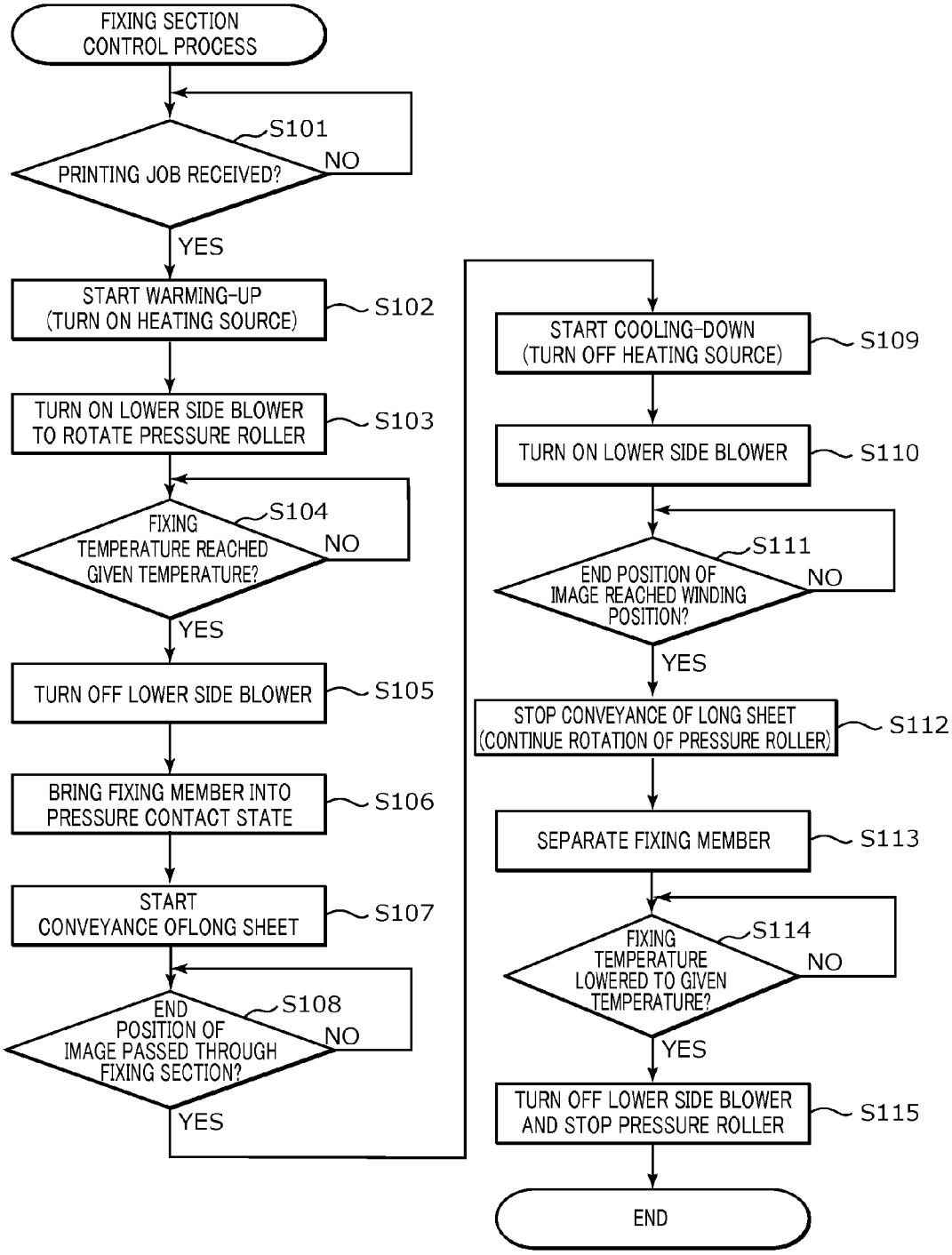
FIG. 5 is a flowchart illustrating an exemplary fixing section control process.

FIG. 5 is a flowchart illustrating an exemplary process (fixing section control process) performed in fixing section 60 during the warming-up and cooling-down. This process is achieved when CPU 81 executes a predetermined program stored in ROM 82 upon the turning on of the power of image forming apparatus 1 for example.

It is assumed that image forming apparatus 1 is in a standby state, and that image forming apparatus 1 returns to the standby state after image formation.

In the standby state, fixing roller 611 and pressure roller 621 are separated from each other. In addition, air blasting of lower side blower 66 is not being performed, and conveyance of long sheets by sheet conveyance section 50 is also not being performed. In addition, ON/OFF of heating source 63 is appropriately controlled to maintain the fixing temperature of fixing roller 611 at the idling temperature lower than the fixable temperature. The fixable temperature and idling temperature are set in advance according to the type of the long sheet used for the image formation.

As illustrated in FIG. 5, at step S101, control section 80 determines whether printing job has been received. When printing job has been received ("YES" at step S101), the process is advanced to step S102.

At step S102, control section 80 starts the warming-up of fixing section 60. During the warming-up, heating by heating source 63 is continued until the fixing temperature of fixing roller 611 reaches the fixable temperature.

At step S103, control section 80 starts the air blasting by lower side blower 66, and controls lower fixing section-driving section 622 to rotate pressure roller 621. At this time, the rotational speed of pressure roller 621 is set to a speed lower than that for image formation. In this manner, it is possible to prevent a long sheet from being damaged by pressure roller 621 making sliding contact with the long sheet.

While, during the warming-up, the fixing temperature of fixing roller 611 increases and thus the value of the heat transmitted to a long sheet increases, pressure roller 621 cooled down by lower side blower 66 rotates in contact with the long sheet so that the long sheet is efficiently cooled, and therefore, discoloration or deformation of the long sheet is not caused.

At step S104, control section 80 determines whether the fixing temperature of fixing roller 611 has reached a given temperature (fixable temperature). When the fixing temperature has reached the fixable temperature ("YES" at step S104), the process is advanced to step S105.

It is to be noted that ON/OFF of heating source 63 is appropriately controlled after the fixing temperature has reached the fixable temperature, and the fixing temperature is maintained at the fixable temperature.

At step S105, control section 80 stops the air blasting of lower side blower 66. It is to be noted that the air blasting of lower side blower 66 may be continued when the air blasting of lower side blower 66 is used to limit the temperature rise of pressure roller 621. In this case, the air volume of lower side blower 66 may be changed.

At step S106, control section 80 controls the operation of pressure contact separation section 64 to bring fixing roller 611 and pressure roller 621 into pressure contact with each other.

At step S107, control section 80 starts the conveyance of long sheets by sheet conveyance section 50. In a case where the rotational speed of pressure roller 621 at the time of the warming-up is set to a speed lower than that for the image formation, the rotational speed is changed according to the sheet conveyance speed of sheet conveyance section 50. On the long sheet, an image based on the printing information included in the printing job is formed.

At step S108, control section 80 determines whether the end position of the image (or the final image in the case where a plurality of images are formed) has been passed through fixing section 60, or in other words, whether the fixing process for all toner images transferred to the long sheet has been completed. When the end position of the image has passed through fixing section 60 ("YES" at step S108), the process is advanced to step S109.

At step S109, control section 80 starts the cooling-down of fixing section 60. During the cooling-down, heating of heating source 63 is stopped until the fixing temperature of fixing roller 611 reaches the idling temperature.

At step S110, control section 80 starts the air blasting of lower side blower 66. While the air blasting of lower side blower 66 may be started after step S111 described later, pressure roller 621 can be efficiently cooled down when the air blow of lower side blower 66 is started after the end position of the image has passed through fixing section 60. Since the fixing process for the all toner images transferred to the long sheet has been completed, the image is not degraded even when pressure roller 621 is cool down.

At step S111, control section 80 determines whether the end position of the image has reached a winding position. When the end position of the image has reached the winding position ("YES" at step S111), the process is advanced to step S112.

At step S112, control section 80 stops the conveyance of long sheets by sheet conveyance section 50. It should be noted that the rotation of pressure roller 621 is continued. At this time, the rotational speed of pressure roller 621 may be changed to a speed lower than that for the image formation. In this manner, it is possible to prevent a long sheet from being damaged when pressure roller 621 makes sliding contact with the long sheet.

At step S113, control section 80 controls the operation of pressure contact separation section 64 to separate fixing roller 611 and pressure roller 621 from each other. The separation raises no problem when fixing roller 611 and pressure roller 621 are separated from each other after the end position of the image has been passed through fixing section 60; however, the long sheet may meander when fixing roller 611 and pressure roller 621 are separated from each other while the long sheet is conveyed. Therefore, it is preferable to establish the separation state after the conveyance of the long sheet is stopped as in the present embodiment. That is, by separating fixing roller 611 and pressure roller 621 from each other after the end position of the image has reached the winding position, meandering of the long sheet can be prevented.

While, during the cooling-down, the fixing temperature of fixing roller 611 is high enough to cause discoloration or deformation of a long sheet, pressure roller 621 cooled down by lower side blower 66 rotates in contact with the long sheet so that the long sheet is efficiently cooled, and therefore discoloration or deformation of the long sheet is not caused.

At step S114, control section 80 determines whether the fixing temperature of fixing roller 611 has reached a given temperature (idling temperature). When the fixing temperature has reached the idling temperature ("YES" at step S114), the process is advanced to step S115.

It is to be noted that, after the fixing temperature has reached the idling temperature, ON/OFF of heating source 63 is appropriately controlled, and the fixing temperature is maintained at the idling temperature.

At step S115, control section 80 stops the air blasting of lower side blower 66, and also controls lower fixing section-driving section 622 to stop the rotation of control pressure roller 621. Since the idling temperature is set to a temperature that causes no discoloration or deformation of a long sheet, discoloration or deformation is not caused even when the cooling down of the long sheet by lower side blower 66 and pressure roller 621 is not performed. Thus, power saving can be achieved by appropriately stopping the operation of lower side blower 66 and pressure roller 621.

As described, image forming apparatus 1 includes: sheet conveyance section 50 configured to convey a long sheet; image forming section 40 configured to transfer a toner image to a long sheet; and fixing section 60 configured to apply heat and pressure to a long sheet conveyed along a sheet feeding path at a fixing nip so as to fix the toner image. Fixing section 60 includes: fixing roller 611 (fixing side member) configured to make contact with a fixing surface of a long sheet; pressure roller 621 (back side supporting member) configured to be brought into pressure contact with fixing roller 611 so as to form a fixing nip; and heating source 63 (heating section) configured to apply heat to fixing roller 611.

In addition, the sheet feeding path has a configuration in which a long sheet makes contact with pressure roller 621 when fixing roller 611 and pressure roller 621 are separated from each other.

During cooling-down or warming-up of fixing section 60, pressure contact separation section 64 separates fixing roller 611 and pressure roller 621 from each other, lower side blower 66 (cooling section) cools down pressure roller 621, and lower fixing section-driving section 622 (driving section) rotates pressure roller 621.

With image forming apparatus 1, since a long sheet is cooled down by the rotation of pressure roller 621 during the cooling-down or warming-up, it is possible to effectively prevent a long sheet from being discolored or deformed by the heat transmission from fixing roller 611. It is not necessary to increase the distance between fixing roller 611 and pressure roller 621 separated from each other, or to provide a heat insulating mechanism, and therefore, problems such as increase in the size of the apparatus and in the cost of the apparatus are not raised. In addition, the conveyance of long sheets is immediately stopped at the time of the non-image formation, the amount of waste paper can be minimized. Furthermore, even a long sheet whose upper temperature limit is low can be warmed up or cooled down without worrying about discoloration or deformation due to heat. Therefore, image forming apparatus 1 is useful as a product.

It is to be noted that the cooling down of fixing section 60 includes a case where the fixing temperature is not lowered to the idling temperature assuming that new printing job is subsequently performed (a case where the fixing temperature is maintained at a temperature around the fixable temperature). Also in this case, since it is preferable to stop the conveyance of long sheets when image formation is not performed on a long sheet, cooling down of a long sheet is performed by lower side blower 66 and pressure roller 621.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, it is possible to employ a pressing member that presses a long sheet against pressure roller 621 in a state where fixing roller 611 (fixing side member) and pressure roller 621 (back side supporting member) are separated from each other.

Figure 6A:
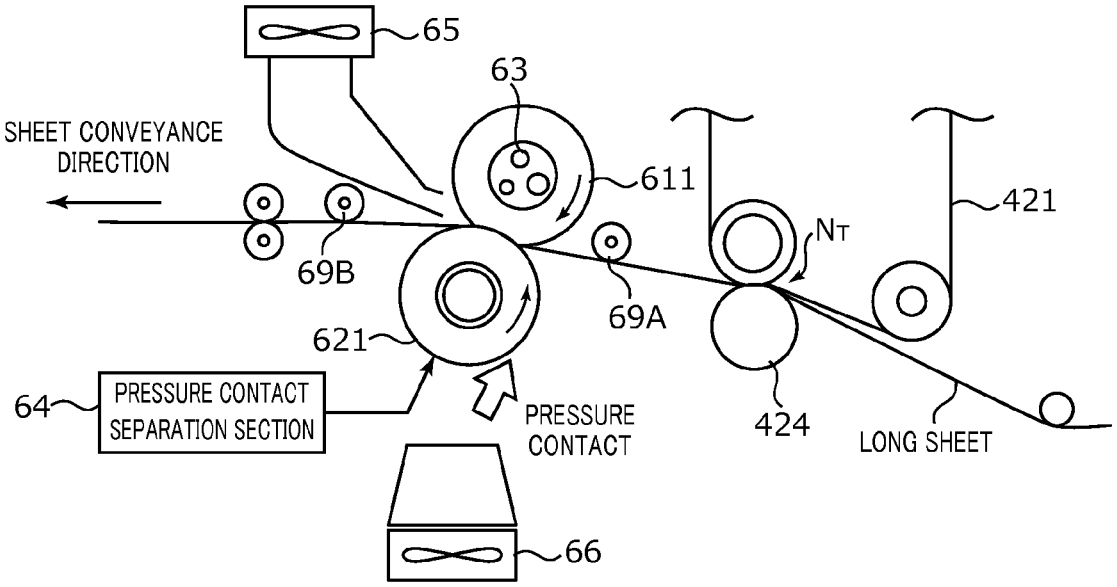
FIG. 6A illustrates another exemplary state (pressure contact state) of the sheet feeding path in the fixing section.
Figure 6B:
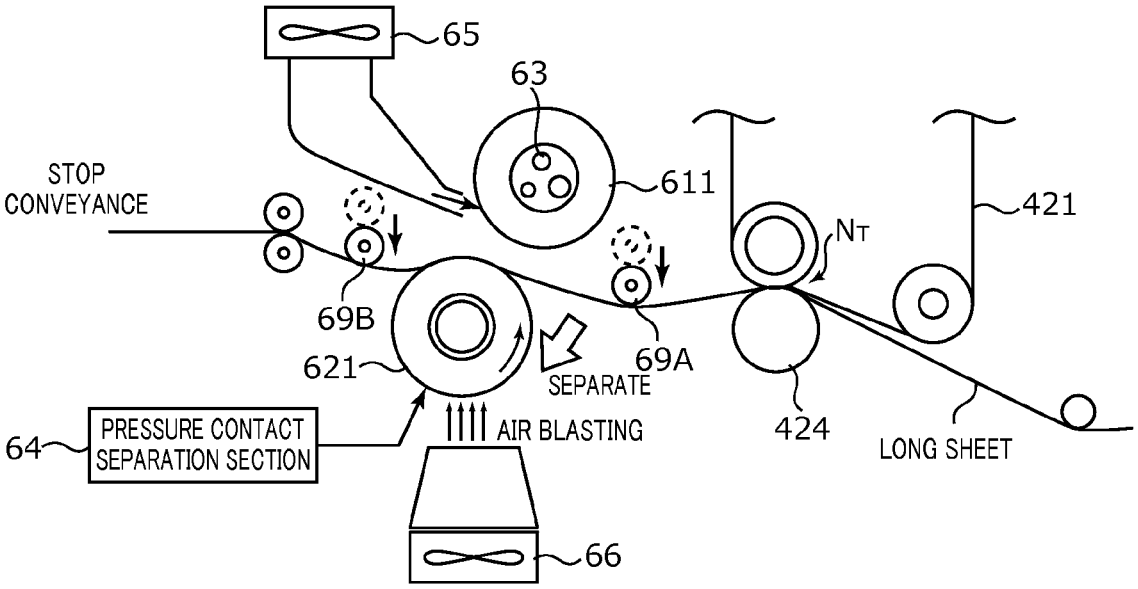
FIG. 6B illustrates another exemplary state (separation state) of the sheet feeding path in the fixing section.

In FIGS. 6A and 6B, as the pressing member, roller members 69A and 69B are respectively disposed on the upstream side and downstream side of fixing section 60 in the sheet conveyance direction. In the pressure contact state illustrated in FIG. 6A, roller members 69A and 69B are disposed in such a manner as to make sliding contact with a long sheet. In the separation state illustrated in FIG. 6B, roller members 69A and 69B move downward, and press a long sheet against pressure roller 621.

Since the pressing member presses a long sheet against pressure roller 621 when conveyance of long sheets is not performed, the pressing member may be a plate-shaped member. In this case, the pressing member is so configured as not to make contact with a long sheet in the pressure contact state illustrated in FIG. 6A.

In image forming apparatus 1, preferably, the winding amount of a long sheet on pressure roller 621 (the length of a part of a long sheet which makes contact with pressure roller 621) can be changed. For example, by adjusting the position of pressure roller 621 in the separation state, the winding amount of long sheet can be changed. In the case where a long sheet is pressed against pressure roller 621 by the pressing member (roller members 69A and 69B) (see FIGS. 6A and 6B), the winding amount of a long sheet on pressure roller 621 can be changed also by adjusting the position of the pressing member.

The greater the winding amount of a long sheet, the greater the contact area between pressure roller 621 and the long sheet, and therefore the efficiency of the cooling increases, thus making it possible to effectively limit discoloration or deformation due to heat. Meanwhile, since the frictional force between a long sheet and pressure roller 621 increases, the possibility that the long sheet is damaged by the rubbing of pressure roller 621 increases. When the winding amount of a long sheet can be changed, the winding amount for efficient cooling can be set in a range not damaging long sheets, thus making it possible to use sheets of various types.

Furthermore, it is preferable to employ a conveyance prevention section that prevents a long sheet from being conveyed by the rotation of pressure roller 621 in a state where long sheets are not conveyed. In this manner, unnecessary slackening of a long sheet can be prevented.

For example, a conveyance roller section (for example, a registration roller section) disposed on the upstream side of fixing section 60 in the sheet conveyance direction may function as a conveyance prevention section. In this case, it is only necessary to increase the nip pressure of the conveyance roller section to a value greater than that for the normal sheet conveyance. In addition, it is also possible to additionally provide a conveyance roller section that has a nip pressure greater than that of the existing conveyance roller section on the upstream side of fixing section 60 in the sheet conveyance direction.

It is also preferable to employ an air-shielding part (for example air-shielding plate) that prevents fixing roller 611 from being cooled by the air blasting of lower side blower 66. In the case where the fixing temperature is increased during the warming-up, and in the case where the fixing temperature is maintained without being lowered to the idling temperature assuming that new printing job is subsequently performed during the cooling-down, fixing roller 611 is cooled down when the air blasting of lower side blower 66 reaches fixing roller 611, and this leads to unintended temperature drop. As a result, the power consumption required for heating up fixing roller 611 increases. By employing the air-shielding part, increase in power consumption due to unintended temperature drop of fixing roller 611 can be prevented.

On the other hand, in the case of normal cooling for reducing the fixing temperature to the idling temperature, fixing roller 611 can be efficiently cooled down by controlling the air blasting of lower side blower 66 to reach fixing roller 611. Therefore, when the air-shielding part is provided, it is preferable that a ventilation state and a non-ventilation state can be switched.

Further, while lower side blower 66 having a cooling fan is adopted as a cooling section for cooling down pressure roller 621 in the embodiment, other types (such as water-cooling type and Peltier type) may be adopted to cool down pressure roller 621.

The embodiment disclosed herein is merely an exemplification and should not be considered as limitative. The scope of the present invention is specified by the following claims, not by the above-mentioned description. It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a sheet conveyance section configured to convey a long sheet;

an image forming section configured to transfer a toner image to a long sheet;

a fixing section including a fixing side member configured to make contact with a fixing surface of a long sheet, a back side supporting member configured to be brought into pressure contact with the fixing side member so as to form a fixing nip, and a heating section configured to apply heat to the fixing side member, the fixing section being configured to apply heat and pressure to a long sheet conveyed along a sheet feeding path at the fixing nip so as to fix the toner image;

a driving section configured to rotate the back side supporting member;

a pressure contact separation section configured to bring the fixing side member and the back side supporting member into pressure contact with each other, or separate the fixing side member and the back side supporting member from each other; and a cooling section configured to cool down the back side supporting member, wherein:

the sheet feeding path has a configuration in which a long sheet makes contact with the back side supporting member when the fixing side member and the back side supporting member are separated from each other; and, during cooling-down or warming-up of the fixing section, the pressure contact separation section separates the fixing side member and the back side supporting member from each other, the cooling section cools down the back side supporting member, and the driving section rotates the back side supporting member.

2. The image forming apparatus according to claim 1, wherein, the sheet feeding path has a form in which a long sheet makes contact with the back side supporting member when the fixing side member and the back side supporting member are separated from each other.

3. The image forming apparatus according to claim 1 further comprising a pressing member configured to press a long sheet against the back side supporting member when the fixing side member and the back side supporting member are separated from each other.

4. The image forming apparatus according to claim 1, wherein, after an end position of an image reaches a winding position during the cooling-down of the fixing section, the pressure contact separation section separates the fixing side member and the back side supporting member from each other, and the sheet conveyance section stops conveyance of a long sheet.

5. The image forming apparatus according to claim 4, wherein, after a fixing temperature of the fixing side member reaches a predetermined idling temperature, the cooling section stops the cooling down of the back side supporting member, and the driving section stops rotation of the back side supporting member.

6. The image forming apparatus according to claim 5, wherein the predetermined idling temperature is set in accordance with a sheet type.

7. The image forming apparatus according to claim 1, wherein, after a fixing temperature of the fixing side member reaches a predetermined fixable temperature during the warming-up of the fixing section, the pressure contact separation section brings the fixing side member and the back side supporting member into pressure contact with each other, and the sheet conveyance section starts conveyance of a long sheet.

8. The image forming apparatus according to claim 7, wherein the predetermined fixable temperature is set in accordance with a sheet type.

9. The image forming apparatus according to claim 1, wherein a winding amount of a long sheet on the back side supporting member is changeable.

10. The image forming apparatus according to claim 1 further comprising a conveyance prevention section configured to prevent a long sheet from being conveyed by rotation of the back side supporting member.

11. The image forming apparatus according to claim 1, wherein the cooling section is a cooling fan configured to cool down the back side supporting member by air blasting.

12. The image forming apparatus according to claim 11 further comprising an air-shielding part configured to prevent the fixing side member from being cooled down by the air blasting of the cooling section.

* * * * *